United States Patent [19]

Kinoshita

[11] Patent Number: 4,896,192

[45] Date of Patent: Jan. 23, 1990

[54] IMAGE FORMING APPARATUS

[75] Inventor: Naoyoshi Kinoshita, Osaka, Japan

[73] Assignee: Minolta Camera Kabushiki Kaisha, Osaka, Japan

[21] Appl. No.: 127,435

[22] Filed: Dec. 2, 1987

[51] Int. Cl.[4] ..... G03G 15/00

[52] U.S. Cl. ..... 355/315; 355/271; 355/274

[58] Field of Search ..... 355/14 CH, 3 TR, 14 TR, 355/271, 274, 315; 271/310, 900

[56] References Cited

U.S. PATENT DOCUMENTS

| | | | |
|---|---|---|---|
| 4,183,653 | 1/1980 | Satomi et al. | 355/3 CH X |
| 4,408,863 | 10/1983 | Ogata et al. | 271/310 X |
| 4,432,631 | 2/1984 | Bacon et al. | 355/225 |
| 4,449,808 | 5/1984 | Abreu | 355/274 |
| 4,640,606 | 2/1987 | Inamoto | 355/315 |
| 4,688,927 | 8/1987 | Oda et al. | 355/14 CH X |
| 4,739,363 | 4/1988 | Hoshika et al. | 355/14 CH X |

FOREIGN PATENT DOCUMENTS

| | | | |
|---|---|---|---|
| 62-81685 | 4/1987 | Japan . | |
| 0247385 | 10/1987 | Japan | 355/271 |

*Primary Examiner*—Arthur T. Grimley
*Assistant Examiner*—Barry J. Shapiro
*Attorney, Agent, or Firm*—Burns, Doane, Swecker & Mathis

[57] ABSTRACT

An image forming apparatus, in which a separation charger for separating from a photosensitive member a paper, when no paper exists between the photosensitive member and the separation charger, is applied with AC voltage, with DC voltage of reverse polarity to the charge polarity of the photosensitive member superposed thereon, thereby preventing the occurrence of paper size memory phenomenon or filming phenomenon.

19 Claims, 7 Drawing Sheets

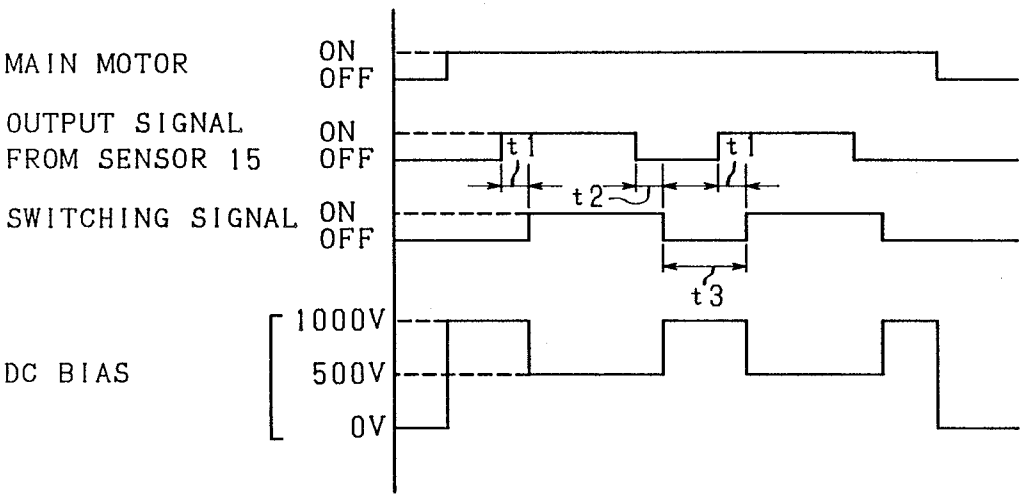
Fig. 4
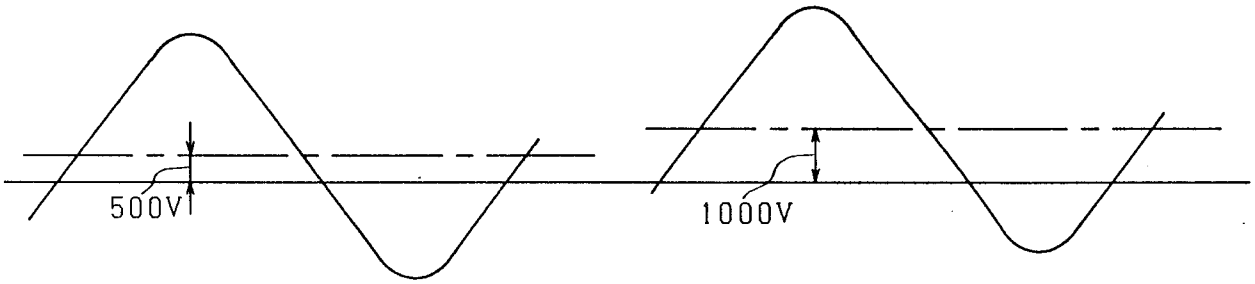
Fig. 5(b)
Fig. 5(a)

DC BIAS OF HIGH VOLTAGE POWER SUPPLY UNIT 8

OUTPUT FROM HIGH VOLTAGE POWER SUPPLY UNIT 17

IMAGE FORMING APPARATUS

BACKGROUND OF THE INVENTION

1. Field of the Invention

The present invention relates to an image forming apparatus, such as a copier or a laser printer having an electrophotographic process.

2. Description of the Prior Art

Generally, the electrographic copying apparatus coronaelectrifies by an electrification charger the surface of a drum-like photosensitive member so as to form uniform electrostatic charge distribution, eliminate the electrostatic charge by a reflection light corresponding to the information to thereby form electrostatic latent images, the latent images are developed by a toner and thereafter transferred to a copying paper and fixed thereon by a heating roller. In order to transfer the images to the copying paper, a transfer charger is adapted to be applied to high voltage of several KV to thereby electrify the rear surface of copying paper and in order to separate the copying paper from the photosensitive member, AC voltage of several KV is adapted to be applied on a separation charger.

In such copying apparatus, however, after a large number of papers (copying papers) of the same size are copied, when a copying paper of larger size is used for copying, the range of the size of the former copying paper becomes slightly black, that is, the so-called paper size memory phenomenon or filming phenomenon, the black portion being called a fog. It is considered that the fog is created by deterioration of the ability to remove the charge by the light at a portion where talc or the like included in the paper attaches to the photosensitive member. As the countermeasure for the above, it is proposed that an erasing corona charger separate from the separation charger is provided and used to remove electricity from the photosensitive member and a cleaner blade for removing residual toner is used to scrape off the attachment. Such a method, however, must be provided with the erasing corona charger for removing charge only, so that it is very difficult to contain such that the charger in a restricted space around the photosensitive member and a new exclusive power source must be provided, thereby creating the problem in that the apparatus is large-sized. Also, it is proposed that a pressing force of the cleaner blade applied on the photosensitive member be increased to scrape off the attachment together with the residual toner, in which the life spans of cleaner blade and photosensitive member are reduced, resulting in lack of practicability.

SUMMARY OF THE INVENTION

The image forming apparatus of the present invention, when no paper exists between the photosensitive member and the separation charger, applies AC voltage, on which DC voltage of reverse polarity to charge of the photosensitive member is superposed, to the separation charger, thereby eliminating the paper size memory phenomenon or the filming phenomenon.

A first object of the invention is to provide an image forming apparatus which can prevent the occurrence of the paper size memory phenomenon without providing an exclusive erasing corona charger.

A second object of the invention is to provide an image forming apparatus which can prevent the occurrence of the paper size memory phenomenon without reducing the life spans of a cleaner blade and the photosensitive member.

A third object of the invention is to provide an image forming apparatus which can dispose parts around the photosensitive member with ease.

A fourth object of the invention is to provide an image forming apparatus which can prevent the occurrence of the paper size memory phenomenon without damaging the separation function of the separation charger.

A fifth object of the invention is to provide an image forming apparatus which varies voltage of the transfer charger in association with that of the separation charger so as to enable further effective prevention of the paper size memory phenomenon.

The above and further objects and features of the invention will more fully be apparent from the following detailed description with accompanying drawings.

BRIEF DESCRIPTION OF THE DRAWINGS

FIG. 4 is a time chart explanatory of operation of the apparatus, FIG. 5 (*a*) and 5 (*b*) are wave form charts of voltage applied to a separation charger.

DESCRIPTION OF THE PREFERRED EMBODIMENTS

Next, an embodiment of an image forming apparatus of the invention will be described with reference to the drawings.

Figure 1:
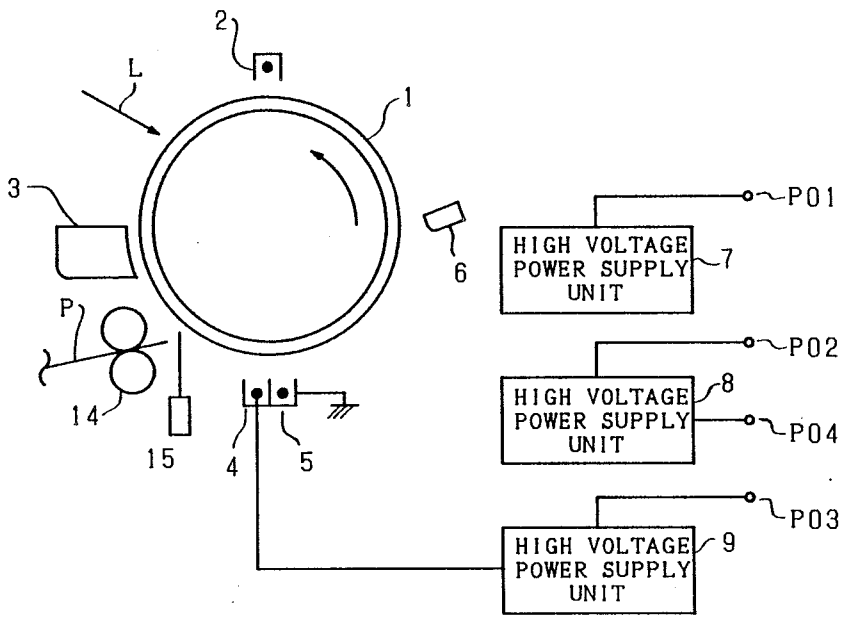
FIG. 1 is a typical view showing components around a photosensitive drum of a first embodiment of an image forming apparatus of the invention.

Referring to FIG. 1, the image forming apparatus of the invention is shown, in which an electrification charger 2, a developing unit 3, a transfer charger 4, a separation charger 5 and a cleaning blade 6 are disposed in the order around a photosensitive drum 1 rotatably driven, the electrification charger 2, transfer charger 4 and separation charger 5 being adapted to be applied with high voltage from high voltage power supply units 7, 9 and 8 respectively.

Figure 2:
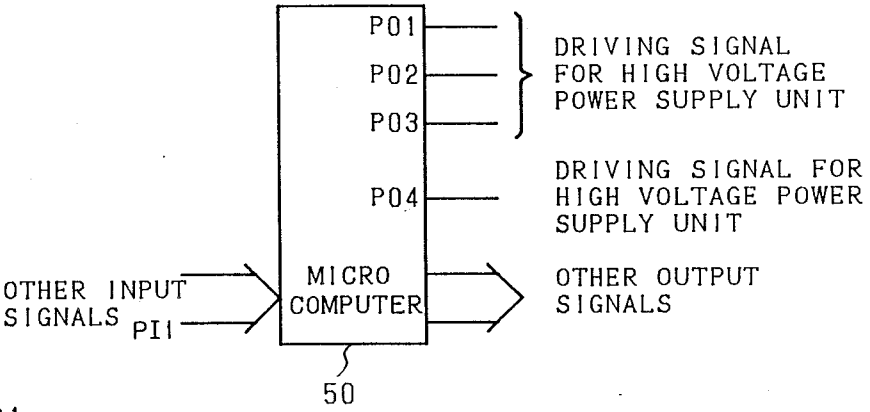
FIG. 2 is an illustration of an input and an output of a microcomputer.

The image forming apparatus is controlled by a microcomputer 50 shown in FIG. 2, the high voltage power supply units 7, 8 and 9 being on-off controlled by outputs from output ports P 01, P 02 and P 03 at the microcomputer 50. DC voltage is applied to the electrification charger 2 and transfer charger 4, and AC voltage including the DC bias component to the separation charger 5 respectively. The high voltage power supply unit 8 is changeable of magnitude of a DC bias component superposed on the separation charger 5 by the output from the output port P04 at the microcomputer 50. Provided under the developing unit 3, are timing rollers 14 which, when a print switch (not shown) is pushed, serve to once stop a copying paper P fed from a paper feeder (not shown) and restart the same after being synchronized with rotation of the photosensitive drum 1. Between the timing rollers 14 and the transfer charger 4 is provided a sensor 15 for detecting that the copying paper P is passing a transfer unit, so that a detection signal from the sensor 15 is introduced into the input port P11 at the microcomputer 50.

In addition, a control signal for the image forming apparatus other than the detection signal is introduced into or output from the microcomputer 50, which is not directly related with the present invention, thereby being omitted of explanation.

Figure 3:
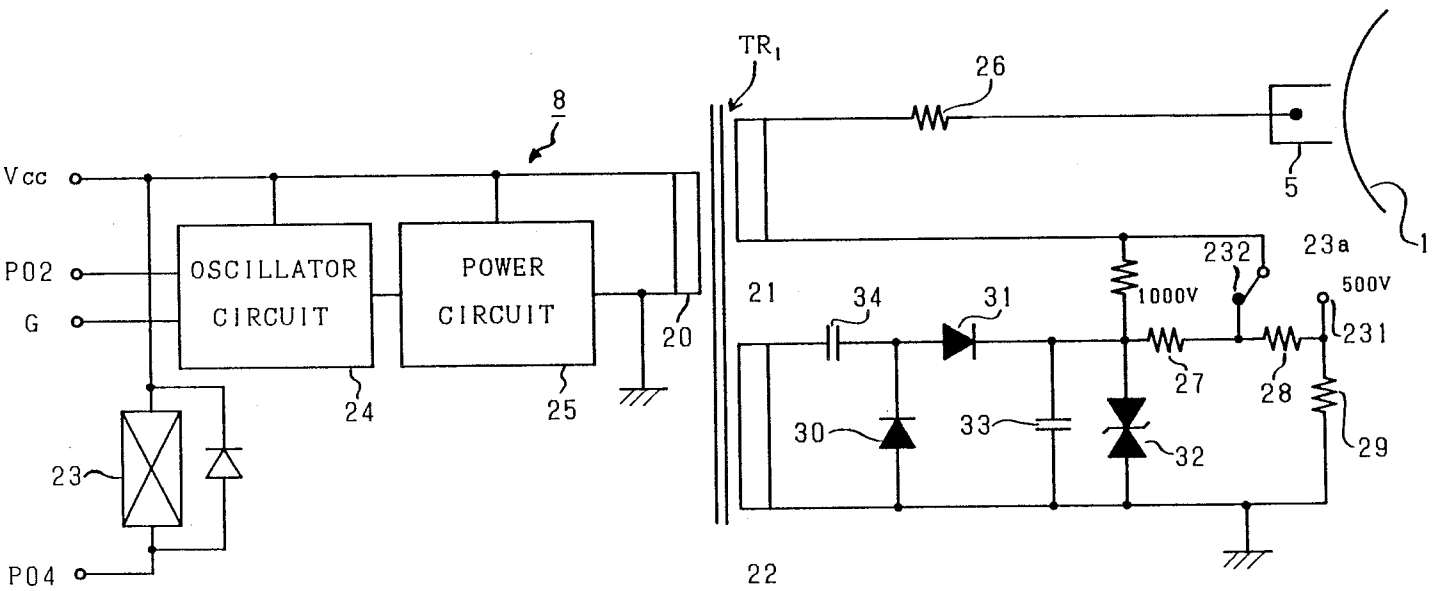
FIG. 3 is a circuit diagram of a high voltage power supply unit.

Next, explanation will be given on the high voltage power supply unit 8 with reference to FIG. 3.

An output port P02 outputting a signal for driving the high voltage power supply unit 8 is connected to an oscillator circuit 24.

The oscillator circuit 24 oscillates by a driving signal from the output port P02 and its output is amplified by a power circuit 25, the amplified output being given to the primary winding of a step-up transformer TR1. AC voltage of 5 KV is obtained at the secondary winding of the transformer TR1 and is given to the separation charger 5 through a resistance 26 connected to one end of the secondary winding 21. A reference numeral 23 designates a relay which is energized when the output of the output port P04 at the microcomputer 50 is active, thereby switching a contact 23*a* to a 500 V side terminal 231 and which is deenergized when the output port P04 is not-active, thereby switching the same to a terminal 232 at the 1000 V side.

The step-up transformer TR1 has a tertiary winding 22 and a voltage doubler rectifier circuit comprising diodes 30 and 31 and capacitors 33 and 34, the output of the rectifier circuit being given to a varistor 32 to thereby obtain the constant voltage output, which is of reverse polarity to the charge polarity of the photosensitive drum 1. The output of varistor 32 is given to a voltage divider comprising resistances 27, 28 and 29 connected in series with each other and two nodes between the resistance 27 and 28, and 29, are connected to the terminal 232 for 1000 V and terminal 231 for 500 V, the contact 23*a* being connected to the other end of the secondary winding 21. In addition, reference letters Vcc and G designate a DC voltage power supply terminal and a grounding terminal.

FIG. 4 is a time chart showing the relation between the output of the sensor 15 for detecting the copying paper and the DC bias voltage applied to the separation charger 5, and FIG. 5 (*a*) and 5 (*b*) show the waveforms of voltages applied to the separation charger 5. In FIGS. 1 through 5, the photosensitive drum 1 is corona-electrified by the electrification charger 2 and exposed by the image exposure L to form electrostatic latent images, which are developed by the developing unit 3 into toner images, and thereafter the toner images are transferred onto the copying paper P fed by the timing roller 14, then the transfer charger 4 is applied with DC voltage so as to charge the rear surface of the copying paper, thereby transferring thereto the toner images from the photo-sensitive drum 1 by means of the electric field on the basis of electrified charge.

Now, simultaneously with driving a main motor (not shown) for rotating the photosensitive drum 1, the output port P02 outputs an ON signal to thereby apply AC voltage to the separation charger 5. At this time, while no copying paper P exits between the separation charger 5 and the photosensitive drum 1, in other words, while the sensor 15 is detecting the copying paper P, the output signal from the output port P04 is non-active, whereby the relay 23 is deenergized and the separation charger 5 is applied with the superposed DC bias voltage of 1,000 V (voltage of waveform shown in FIG. 5-(*b*)). When printing operation is started, the timing roller 14 rotates at a proper timing so as to coincide with the toner images formed on the photosensitive drum 1, thereby transporting forward the copying paper P. Hence, when the sensor 15 detects the utmost end of the copying paper P and the time t1 is counted by an internal timer in the microcomputer 50, the signal from the output port P04 is turned active regarding that the copying paper P has reached between the separation charger 5 and the photosensitive drum 1, whereby the signal from the output port P04 is turned active and the relay 23 is energized to switch its contact 23*a* to lower the DC bias component of voltage to be applied to the separation charger 5 from 1,000 V to 500 V (refer to FIG. 5-(*a*)). When the sensor 15 detects that the rear end of copying paper P has passed, after the lapse of time t2 by the timer, the signal from the output port P04 is turned non-active regarding that the rear end of the same has passed between the separation charger 5 and the photosensitive drum 1. Hence, the relay 23 returns to switch the contact 23*a*, thereby again increasing to 1,000 V the DC bias component of voltage to be applied to the separation charger 5 (refer to FIG. 5-(*b*)). The lower voltage value (500 V) of DC bias is low to an extent of no scattering of toner on the copying paper P. When no copying paper exists between the separation charger 5 and the photosensitive drum 1, the DC bias is made high, thereby improving the charge removing effect of the photosensitive drum 1 and preventing the occurrence of paper size memory phenomenon. The aforesaid time t1 is made smaller than the time required to move the copying paper P from the position of sensor 15 to that of separation charger 5, the time t2 being made larger than the time required to allow the copying paper P to pass from the position of sensor 15 to that of separation charger 5.

Figure 6:
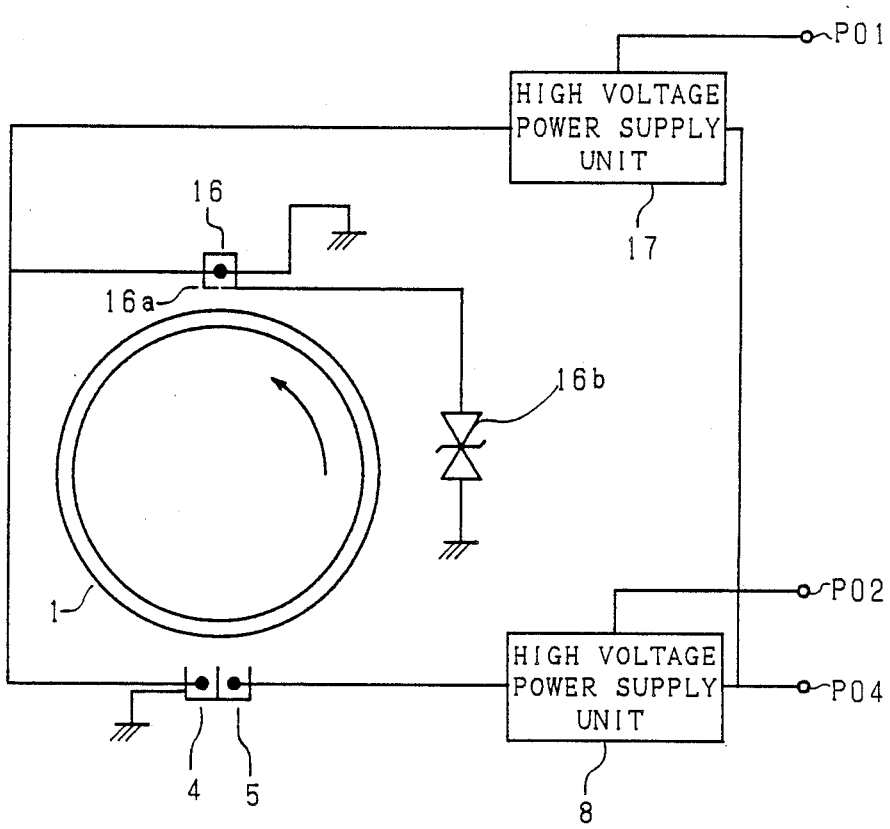
FIG. 6 is a typical view around a photosensitive drum of a second embodiment of the image forming apparatus of the invention.
Figure 7:
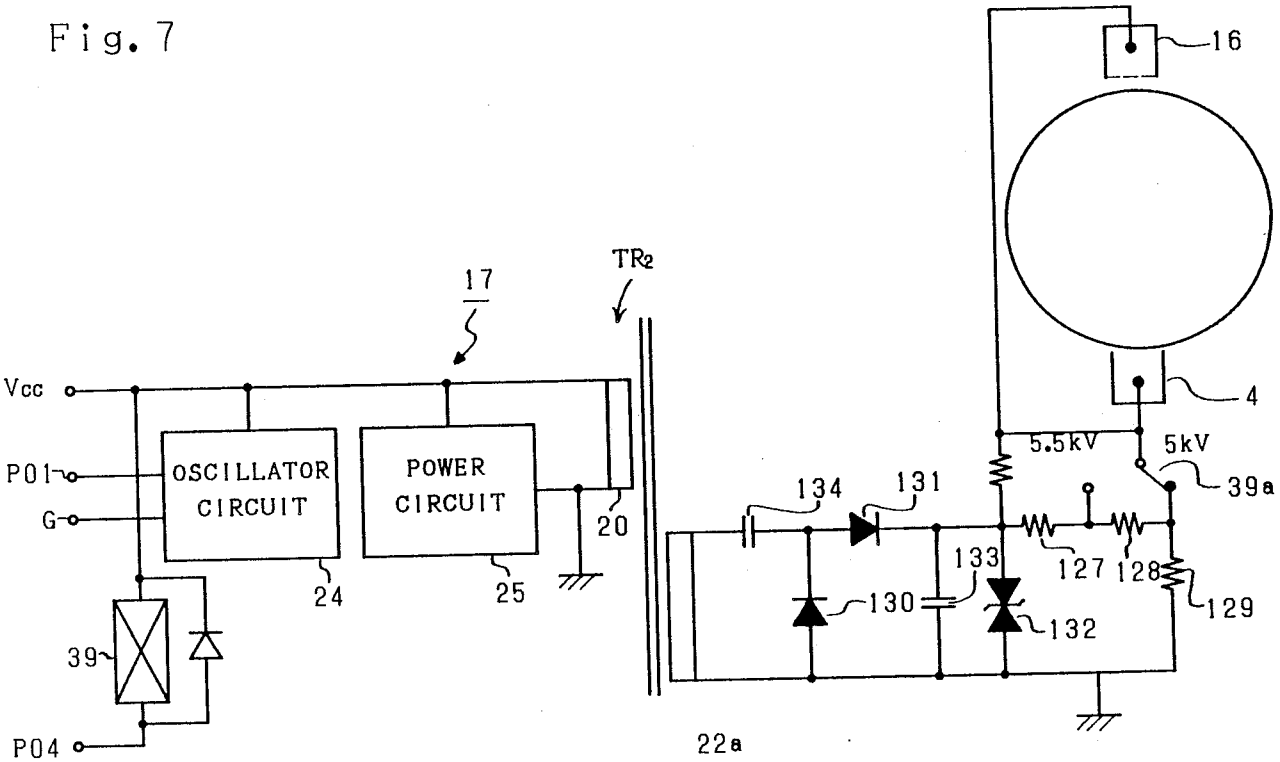
FIG. 7 is a circuit diagram of a high voltage power supply unit.

Referring to FIGS. 6 and 7, a second embodiment of the invention is shown. In addition, this embodiment is so constructed that the transfer charger 4, when no copying paper exists, is applied with low voltage in order to raise the DC bias effect of the separation charger 5, in which the components like those in the first embodiment are designated by the same reference numerals. Also, in this embodiment an electrification charger 16 and the transfer charger 4 are common in a power source. Next explanation will be given on the second embodiment.

The electrification charger 16 and transfer charger 4 are connected to a common high voltage power supply unit 17 as above-mentioned, which is on-off controlled by an output signal from the output port P01 at a microcomputer 50 and connected to the output port P04 at the microcomputer 50 so that, when the DC bias component of the separation charger 5 is switched of its magnitude, simultaneously, the transfer charger 4 and electrification charger 16 are adapted to be switched of voltage. The electrification charger 16, however, is provided between it and the photosensitive drum 1 with a scorotron 16*a* which is grounded through a varistor 16*b*, so that potential applied by the electrification charger 16 to the photosensitive drum 1 is not changed. A high voltage power supply unit 8 for the separation charger 5 is of the same construction as the first embodiment.

In FIG. 7, the high voltage power supply unit 17 is shown, in which an output from the output port P01 for driving the same is introduced into an oscillator circuit 24. The oscillator circuit 24 and a power circuit 25 are connected to the primary winding 20 of a step-up transformer TR2. Meanwhile, the secondary winding 22*a* thereof is connected to the electrification charger 16 and transfer charger 4 through a rectifier comprising diodes 130 and 131 and capacitors 133 and 134, resistance 127, 128 and 129, and a contact 39*a* of a relay 39. The relay 39, when the signal from the output port P04 is active, is energized to switch the contact 39*a* toward the node of the resistances 127 and 128, thereby apply to the transfer charger 4 voltage of 5.5 KV. The relay 39, when the signal is non-active, is deenergized to switch the contact 39*a* as shown to thereby apply to the same voltage of 5 KV.

Figure 8:
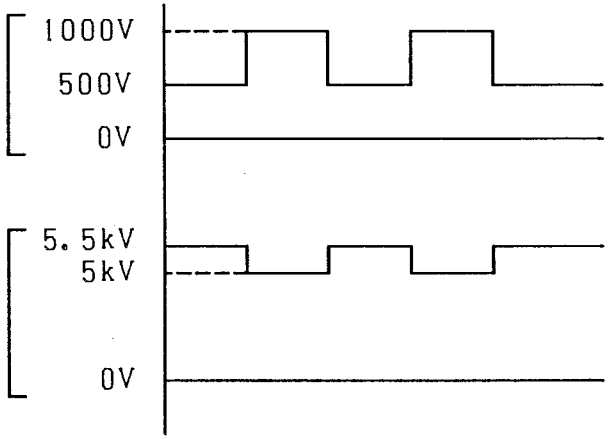
FIG. 8 is a time chart explanatory of operation of the power supply unit shown in FIG. 7.

In brief, in explanation with reference to FIG. 8, when the aforesaid sensor 15 detects that no copying paper P exists on the transfer charger 4 and separation charger 5, the output port P04 is non-active, the DC bias of the high voltage power supply unit 8 becomes high at 1,000 V, and the output of the high voltage power supply unit 17 is 5 KV. On the other hand, when the copying paper P exists between the photosensitive drum 1 and the separation charger 5, the output port P04 is turned active and the relay 39 is energized, so that the DC bias becomes 500 V and the output of high voltage power supply unit 17 rises up to 5.5 KV. Thus, voltage applied to the separation charger 5 when no copying paper P exists on the transfer charger 4 is lowered, thereby enabling further effective prevention of the size memory phenomenon.

Figure 9:
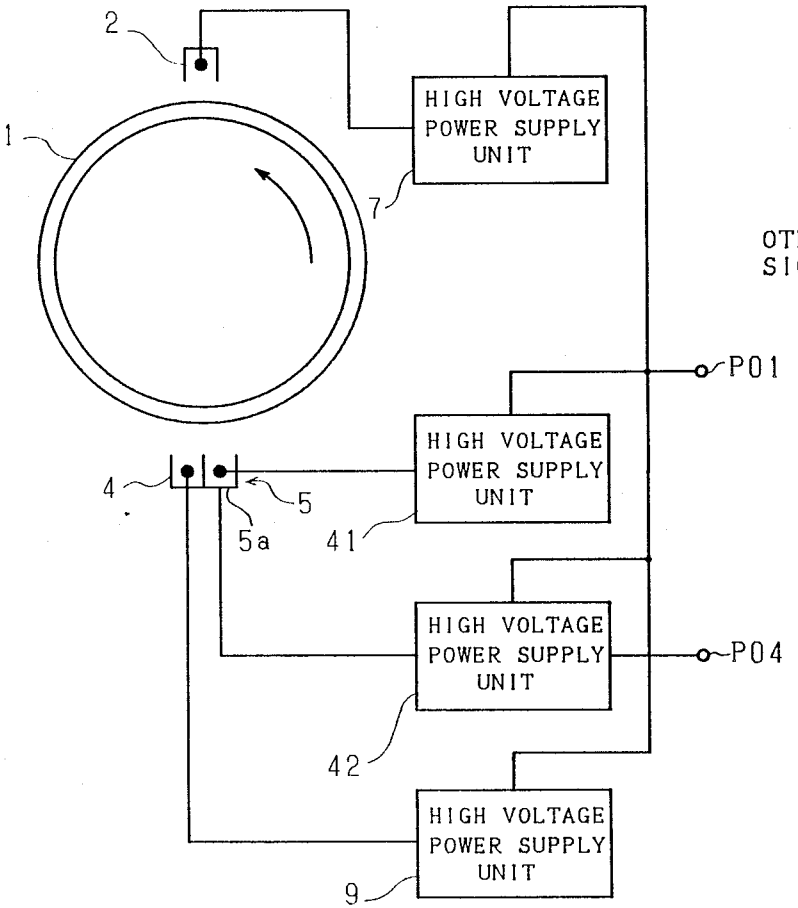
FIG. 9 is a typical view around a photosensitive drum of a third embodiment of the image forming apparatus of the invention.

FIG. 9 shows a third embodiment of the invention, in which an electrification charger 2, a transfer charger 4 and a separation charger 5 are connected to a high DC voltage power supply unit 7, a high DC voltage power supply unit 9 and a high AC voltage power supply unit 41 respectively and they are on-off controlled by a signal from an output port P01 at a microcomputer 50. A stabilizer 5*a* at the separation charger 5 is connected to a high DC voltage power supply unit 42 of reverse polarity to the power supply units 7, 9, the DC voltage power supply unit 42 being on-off controlled together with other voltage power supply units by the signal from the output port P01 and a switching signal from the output port P04 can apply to the unit 42 DC voltage of reverse polarity to the charge polarity of photosensitive drum 1 and of the two high and low stages.

Accordingly, when no copying paper exists on the separation charger 5, the input to a switching terminal P04 increases the DC bias voltage to the stabilizer 5*a* so as to raise the effect of removing charge from the photosensitive drum 1, thereby enabling prevention of the paper size memory phenomenon.

In addition, in the aforesaid embodiments of the invention, the sensor 15 detects passage of copying paper P. Alternatively, means is provided which previously detects the size of the copying paper to be fed, whereby the on-off timing of the charger may be controlled by data of a length of the transported copying paper and the timing of driving the timing roller.

Alternatively, the separation charger 5, which is always applied with AC voltage, may not be applied with AC voltage, but only with DC voltage when no copying paper passes, the applied DC voltage being preferred to be about 5 KV then.

As seen from the above, in the present invention, the separation charger is applied with DC voltage of reverse polarity to the charge polarity of the photosensitive member superposed on AC voltage, so that, when no copying paper exists between the photosensitive member and separation charger, the DC bias voltage increases, thereby enabling the charge to be removed from the photosensitive drum 1. Hence, there is no need of changing construction in the vicinity of photosensitive member from the conventional one, whereby the apparatus can be compact. Also, the photosensitive member can effectively be removed of its charge without reducing the life span of the photosensitive member or the cleaner blade, thereby enabling prevention of the occurrence of the so-called paper size memory phenomenon.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An image forming apparatus comprising:

a photosensitive member having photosensitive layer thereon;

means for charging said photosensitive member and forming thereon electrostatic latent images;

developing means for developing said electrostatic latent images formed on said photosensitive member into visible images;

a transfer charger for transferring onto a paper said visible images;

a separation charger for separating said paper from said photosensitive member;

a first voltage applying means for applying AC voltage to said separation charger;

paper detection means which outputs a signal corresponding to whether or not said paper exists between said separation charger and said photosensitive member; and a second voltage applying means for applying DC voltage to said separtion charger when said paper detection means outputs a signal indicating that no paper exists between said separation charger and said photosensitive member, said DC voltage being of reverse polarity to the polarity of the electrostatic latent image on said photosensitive member.

2. An image forming apparatus as set forth in claim 1, wherein said first voltage applying means is off when said detection means outputs the signal indicating that no paper exists between said separation charger and said photosensitive member.

3. An image forming apparatus as set forth in claim 1, wherein said paper detection means is provided with a paper sensor disposed in upstream of said transfer charger in respect to the paper transporting direction and with delay means for delaying an output of said paper sensor for a predetermined time.

4. An image forming apparatus as set forth in claim 1, wherein said second voltage applying means, when said paper detection means outputs the signal indicating that said paper exists between said separation charger and said photosensitive member, applies to said separation charger DC voltage which is lower than that when said paper detection means outputs the signal indicating that no paper exists between said separation charger and said photosensitive member.

5. An image forming apparatus as set forth in claim 1, wherein said second voltage applying means applies DC voltage to a stabilizer plate at said separation charger.

6. An image forming apparatus comprising;

a photosensitive member having a photosensitive layer thereon;

means for charging said photosensitive member and forming thereon electrostatic latent image;

developing means for developing said electrostatic latent image formed on said photosensitive member into visible images;

a transfer charger for transferring on said paper said visible image formed on said photosensitive member;

a separation charger for separating said paper from said photosensitive member;

a first voltage applying means which applies AC voltage to said separation charger;

paper detection means which outputs a signal corresponding to whether or not said paper exists between said separation charger and said photosensitive member;

a second voltage applying means for applying DC voltage to said separation charger when said paper detection means outputs a signal indicating that no paper exists between said separation charger and said photosensitive member, the polarity of said DC voltage being reverse to that of said photosensitive member when being charged; and a third voltage applying means for applying DC voltage to said transfer charger, said DC voltage, when said paper detection means outputs a signal indicating that no paper exists between said separation charger and said photosensitive member, being lower than that when said paper detection means is outputting a signal indicating that said paper exists.

7. An image forming apparatus as set forth in claim 6, wherein said first voltage applying means is off when said detection means outputs the signal indicating that no paper exists between said separation charger and said photosensitive member.

8. An image forming apparatus as set forth in claim 6, wherein said paper detection means is provided with a paper sensor disposed upstream of said transfer charger in respect to the paper transporting direction and with delay means for delaying an output of said paper sensor for a predetermined time.

9. An image forming apparatus as set forth in claim 6, wherein said second voltage applying means, when said paper detection means outputs the signal indicating that said paper exists between said separation charger and said photosensitive member, applies to said separation charger DC voltage which is lower than that when said paper detection means outputs the signal indicating that no paper exists between said separation charger and said photosensitive member.

10. An image forming apparatus as set forth in claim 6, wherein said second voltage applying means applies DC voltage to a stabilizer plate at said separation charger.

11. An image forming apparatus comprising, a photosensitive member having a photosensitive layer thereon;

an electrification charger for applying charge to said photosensitive member, exposure means for forming electrostatic latent image on said photosensitive member, developing means for developing said electrostatic latent image on said photosensitive member into toner image, a transfer charger for transferring on said paper said toner image formed on said photosensitive member;

a separation charger for separating a paper from said photosensitive member;

cleaning means for removing from the surface of said photosensitive member residual toner thereon;

means for detecting that a paper exists between said separation charger and said photosensitive member;

means for applying to said separation charger AC voltage on which DC voltage is superposed, and means for reducing said DC voltage component when said paper exists between said photosensitive member and said separation charger.

12. An image forming apparatus comprising:

a photosensitive member having photosensitive layer thereon;

means for charging said photosensitive member and forming thereon electrostatic latent images;

developing means for developing said electrostatic latent images formed on said photosensitive member into visible images;

a transfer charger for transferring onto a paper said visible images formed on said photosensitive member;

a separation charger for separating said paper from said photosensitive member;

a first voltage applying means for applying AC voltage to said separation charger;

paper detection means which outputs a signal corresponding to whether or not said paper exists between said separation charger and said photosensitive member;

a second voltage applying means for applying DC voltage to said separation charger, said DC voltage being of reverse polarity to the polarity of the electrostatic latent image on said photosensitive member; and a control means for controlling the second voltage applying means so as to apply DC voltage to said separation charger when said paper detection means outputs a signal indicating that no paper exists between said separation charger and said photosensitive member and to apply smaller DC voltage when said paper detection means outputs a signal indicating that paper exists between said separation charger and said photosensitive member.

13. An image forming apparatus as set forth in claim 12, wherein said first voltage applying means is off when said detection means outputs the signal indicating that no paper exists between said separation charger and said photosensitive member.

14. An image forming apparatus as set forth in claim 12, wherein said paper detection means is provided with a paper sensor disposed in upstream of said transfer charger in respect to the paper transporting direction and with delay means for delaying an output of said paper sensor for a predetermined time.

15. An image forming apparatus as set forth in claim 12, wherein said second voltage applying means applies DC voltage to a stabilizer plate at said separation charger.

16. An image forming apparatus comprising:

a photosensitive member having photosensitive layer thereon;

means for charging said photosensitive member and forming thereon electrostatic latent images;

developing means for developing said electrostatic latent images formed on said photosensitive member into visible images;

a transfer charger for transferring onto a paper said visible images formed on said photosensitive member;

a separation charger for separating said paper from said photosensitive member;

a first voltage applying means for applying AC voltage to said separation charger;

paper detection means which outputs a signal corresponding to whether or not said paper exists between said separation charger and said photosensitive member;

a second voltage applying means for applying DC voltage to said separation charger, said DC voltage being of reverse polarity to the polarity of the electrostatic latent image on said photosensitive member; and a first control means for controlling the second voltage applying means so as to apply DC voltage to said separation charger when said paper detection means outputs a signal indicating that no paper exists between said separation charger and said photosensitive member and to apply smaller DC voltage when said paper detection means outputs a signal indicating that paper exists between said separation charger and said photosensitive member;

a third voltage applying means for applying DC voltage to said transfer charger, said DC voltage being of the same polarity to the polarity of the electrostatic latent image on said photosensitive member; and a second control means for controlling the third voltage applying means so as to apply DC voltage to said separation charger when said paper detection means outputs the signal indicating that paper exists between said separation charger and said photosensitive member and to apply smaller DC voltage when said paper detection means outputs the signal indicating that no paper exists between said separation charger and said photosensitive member.

17. An image forming apparatus as set forth in claim 16, wherein said first voltage applying means is off when said detection means outputs the signal indicating that no paper exists between said separation charger and said photosensitive member.

18. An image forming apparatus as set forth in claim 16, wherein said paper detection means is provided with a paper sensor disposed in upstream of said transfer charger in respect to the paper transporting direction and with delay means for delaying an output of said paper sensor for a predetermined time.

19. An image forming apparatus as set forth in claim 16, wherein said second voltage applying means applies DC voltage to a stabilizer plate at said separation charger.

* * * * *